US006256913B1

(12) United States Patent
Pellegri

(10) Patent No.: US 6,256,913 B1
(45) Date of Patent: Jul. 10, 2001

(54) PACKAGING WRAPPER OR CONTAINER AND PROCESS FOR THE PRODUCTION THEREOF

(76) Inventor: Rodolfo Pellegri, Via Vasari, 12, 20135 Milan (IT)

( * ) Notice: Subject to any disclaimer, the term of this patent is extended or adjusted under 35 U.S.C. 154(b) by 0 days.

(21) Appl. No.: 09/188,500

(22) Filed: Nov. 9, 1998

(30) Foreign Application Priority Data

Nov. 11, 1997 (IT) ..... MI97A2510

(51) Int. Cl.[7] ..... G09F 3/18
(52) U.S. Cl. ..... 40/654.01; 40/661
(58) Field of Search ..... 40/661, 771, 776, 40/654.01; 206/449; 383/39; 229/71

(56) References Cited

U.S. PATENT DOCUMENTS 3,943,645 * 3/1976 Viesturs ..... 40/661
4,305,216 * 12/1981 Skelton ..... 40/776 X
5,259,136 * 11/1993 Goserud ..... 40/661 X
5,323,553 * 6/1994 Candido ..... 40/661 X
5,362,540 * 11/1994 Keng ..... 40/661 X
5,461,810 * 10/1995 Goserud ..... 40/661
5,826,358 * 10/1998 DeSutter ..... 40/661 X

* cited by examiner

*Primary Examiner*—Joanne Silbermann
(74) *Attorney, Agent, or Firm*—Darby & Darby

(57) ABSTRACT

A packaging wrapper or container and a process for the production thereof, providing that the wrapper or container is made up of a first film of transparent material which is partially covered by a sheet having advertising messages, and superimposed on the first layer of transparent material and the sheet containing the advertising messages is a second layer of transparent film, which film, on the side towards the sheet having the advertising messages and towards the first film of transparent material, receives an adhesive coating.

9 Claims, 3 Drawing Sheets

PACKAGING WRAPPER OR CONTAINER AND PROCESS FOR THE PRODUCTION THEREOF

DESCRIPTION OF THE INVENTION

The present invention relates to a packaging wrapper or container and a process for the production thereof. Packaging containers of transparent synthetic material are suitable for receiving products such as for example socks and stockings, knitted underwear, compact discs, leather goods, books, hardware goods, tobacco, frozen goods, food products, pharmaceuticals or the like but they can also act as a packaging wrapper for more bulky articles such as for example pullovers, shirts or blouses or vests or footwear. It is known that the above-indicated articles are frequently packaged by using containers or wrappers of transparent synthetic material, being a thermoplastic material which is usually welded along the peripheral sides to join together the two superposed layers of film of synthetic material.

The wrappers or containers produced with superposed layers which are welded along the edges are often provided with printing on the outside thereof in order to afford the advertising slogans.

The operation of printing the advertising slogans is relatively complicated, the quality achieved is not outstanding and in practice the printing operation cannot be implemented in regard to a small numbers of packaging containers and wrappers.

In addition the advertising effect of the slogans which are printed directly on the synthetic material is not high quality.

A further disadvantage of the known containers or wrappers which are welded along the edges is that frequently the weld is not sufficiently strong for the use for which the container is intended.

In addition the containers which are known from the state of the art involve a reduced degree of three-dimensional stability. That fact requires that, during the packaging procedure, that is to say during introduction of the article into the wrapper, the article will have to be disposed within a reinforcing cardboard container. Such a packaging system is laborious and therefore expensive, leaving a generally unattractive part of the packaged product in view.

From the prior art are known packaging wrappers or containers printed with an offset of flexographic process, the result obtained is not of high quality and the known proceedings are useable only for volume production. The aim of the present invention is therefore to avoid the disadvantages which are encountered in the state of the art formed by the common holders or cases of paper and bags of welded material, and to propose a packaging wrapper or container and a process for the production thereof, which do not suffer from the disadvantages of the state of the art, which is resistant to the mechanical stresses involved and which has a layer of stiffening material acting as a reinforcement and at the same time as a carrier for advertising.

Another aim of the invention is to provide wrappers or containers of higher quality, making it possible to produce even small quantities in a rational and economic manner in a short time and with the optimum colour representation and efficiency.

That aim is achieved by a packaging wrapper or container which is composed of a first film of material which is partially covered by a reinforcing sheet containing advertising messages, and that joined to the first film of transparent material and the reinforcing sheet containing the advertising messages is a second film of transparent material which, on the side towards the reinforcing sheet having the advertising messages and towards the first film of transparent material, receives an adhesive layer.

The process as proposed in accordance with the present invention provides for the feed of a first film in roll form on which are disposed individual sheets acting as a reinforcement and an advertising carrier, that a second transparent film is then disposed on the first film and the reinforcing sheets, said second film being joined under pressure and by means of a layer of glue to the reinforcing sheets and to the peripheral edges which are not covered of the first film.

Thus the invention provides a wrapper in the form of a container, by means of two transparent layers. The two transparent films of synthetic material are glued together along the peripheral edges forming a very resistant wrapper or container and a reinforcing insert, for example a cardboard insert, having an advertising message on one or two faces, is precisely positioned and laminated and fixed in position in the interior of the wrapper or container.

Advantageously, a material involving the same chemical base (mono-product), for example a product based on cellulose or polypropylene, is used both for the sheet containing the advertising messages and for the films to be joined together.

The subject of the present invention will now be described in greater detail and illustrated by means of an embodiment given solely by way of example with reference to the accompanying drawings.

DETAILED DESCRIPTION OF THE PREFERRED EMBODIMENT

Figure 1:
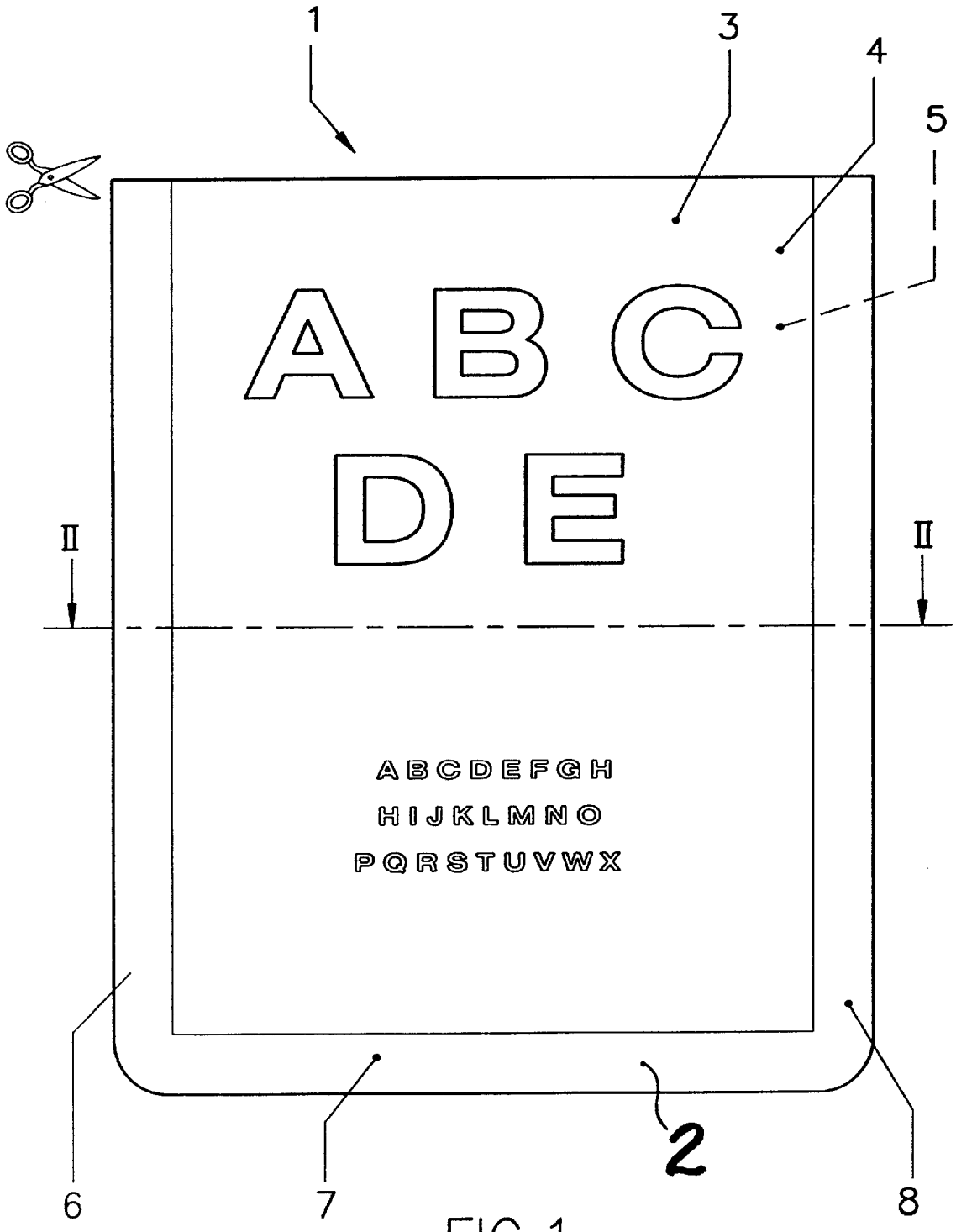
FIG. 1 is a front view of the wrapper or container.

As can be noted from FIG. 1 the wrapper or container which is indicated generally by reference numeral 1 is composed of a first layer formed by a film 2 of advantageously transparent material. Individual sheets 3 of suitable material, for example a sheet of paper, cardboard or other materials, are deposited on the layer 2 by means of a known feeder.

On one or both of their faces the sheets 3 have advertising illustrations or writing which is advantageously produced by an offset process. By virtue of being joined to the transparent film the advertising printing is in practice plastic-covered and thus substantially caused to stand out as regards the colour effects.

During production the film 2 and the corresponding sheet 3 are covered by a further layer formed by a film 4 which receives a layer of glue 5 on the face which is towards the sheet 3 and the subjacent film 2.

Advantageously, both the sheet 3 and the films 2 and 4 are made of cellulose-based material, thus permitting easy recycling of the material after use.

Figure 2:
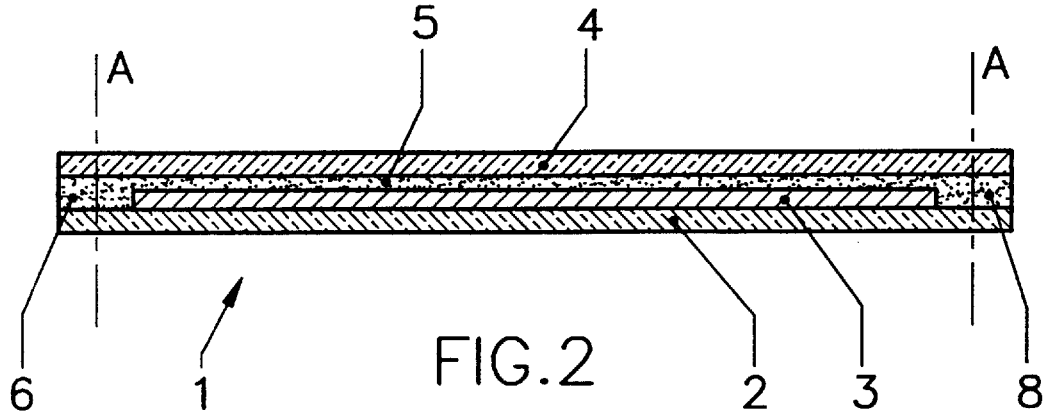
FIG. 2 shows the wrapper or container in section taken along the line II—II in FIG. 1.

By applying a suitable pressure to the layer 2, the sheet 3 (of smaller dimensions than the films 2 and 4) and the glue-coated layer 4, the result is that the films 2 and 4 are glued together firmly along the edges 6, 7 and 8. At the same time the sheet 3 which is inserted between the two films 2 and 4 and which carries the advertising messages on its faces is fixed precisely in the desired position. Reference will now be made to the FIG. 2 showing a view in cross-section of the container which is indicated generally with reference 1.

The sheet 3 with the advertising printing is freely positioned on the layer of transparent material indicated by reference numeral 2 and an advantageous join is produced between the films 2 and 4 along the edges 6, 7 and 8 by means of a layer of glue 5 which is applied to the film 4. At the same time a firm join is also produced between the film 4 and a face of the paper or cardboard insert 3. As diagrammatically indicated by the lines (A) the container 1 produced in that way will be trimmed or punched along the edges 6, 7 and 8.

Figure 3:
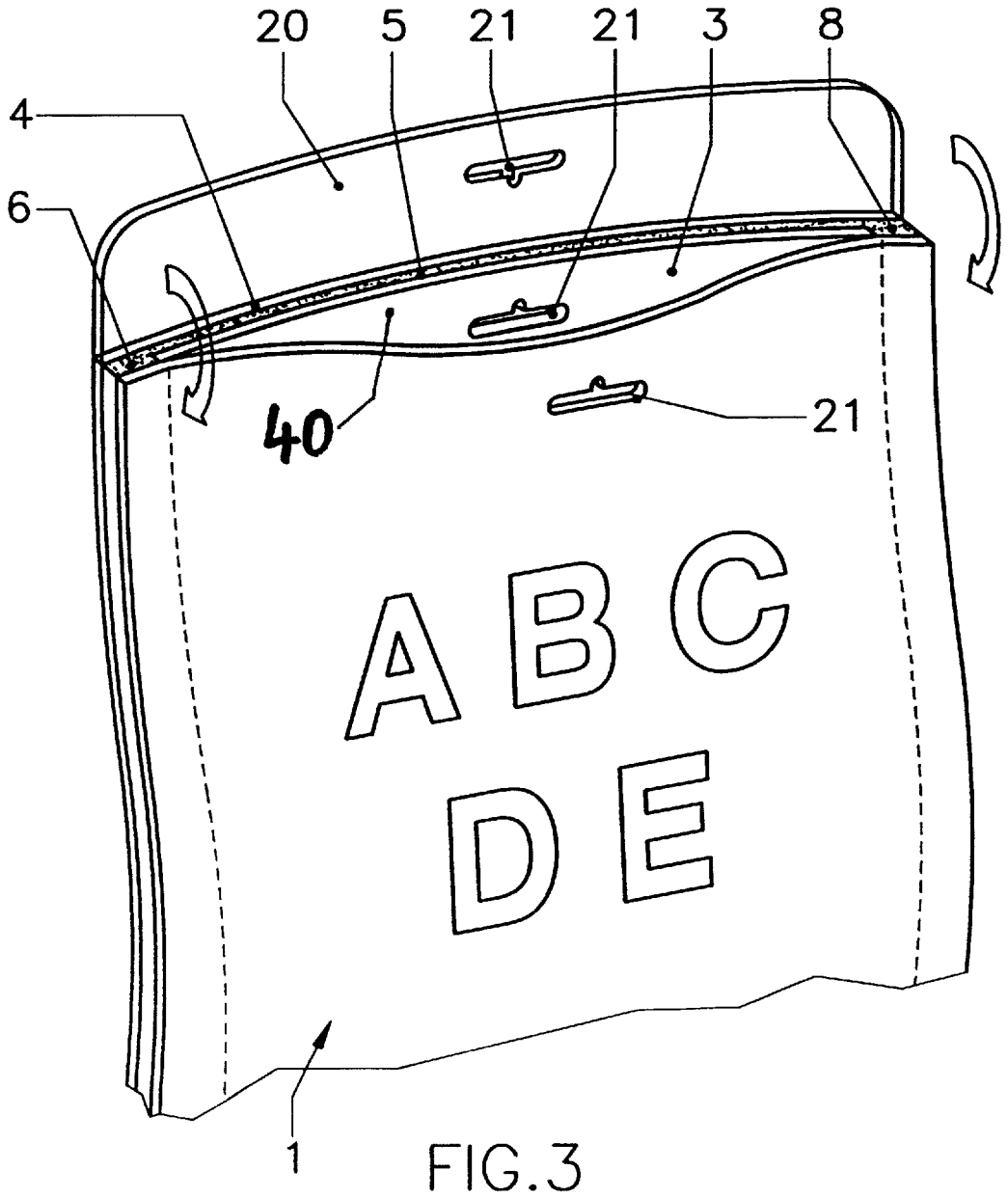
FIG. 3 is a perspective view of part of the container or wrapper, and FIG. 4 diagrammatically shows the apparatus for producing the container.

Reference is made to FIG. 3 showing a perspective view of part of the container 1. If desired the container 1 can also be provided with a closure flap 20 and cut-out openings 21 which permit the container 1 to be hung up.

In such a case suitable means will be provided for covering the flap 20 (if it is provided) in such a way as to prevent the non desired deposit of glue 5 thereon. Obviously it is also possible to provide the flap with a biadhesive strip.

FIG. 3 shows the film 4 which is covered with a layer of glue 5 which permits the reinforcing insert 3 to be fixed in position with respect to the film 4. At the same time it can be seen from FIG. 3 that the layer of glue also makes it possible for the films 2 and 4 to be firmly joined together along the free edges, for example 6 and 8 of the container 1.

Figure 4:
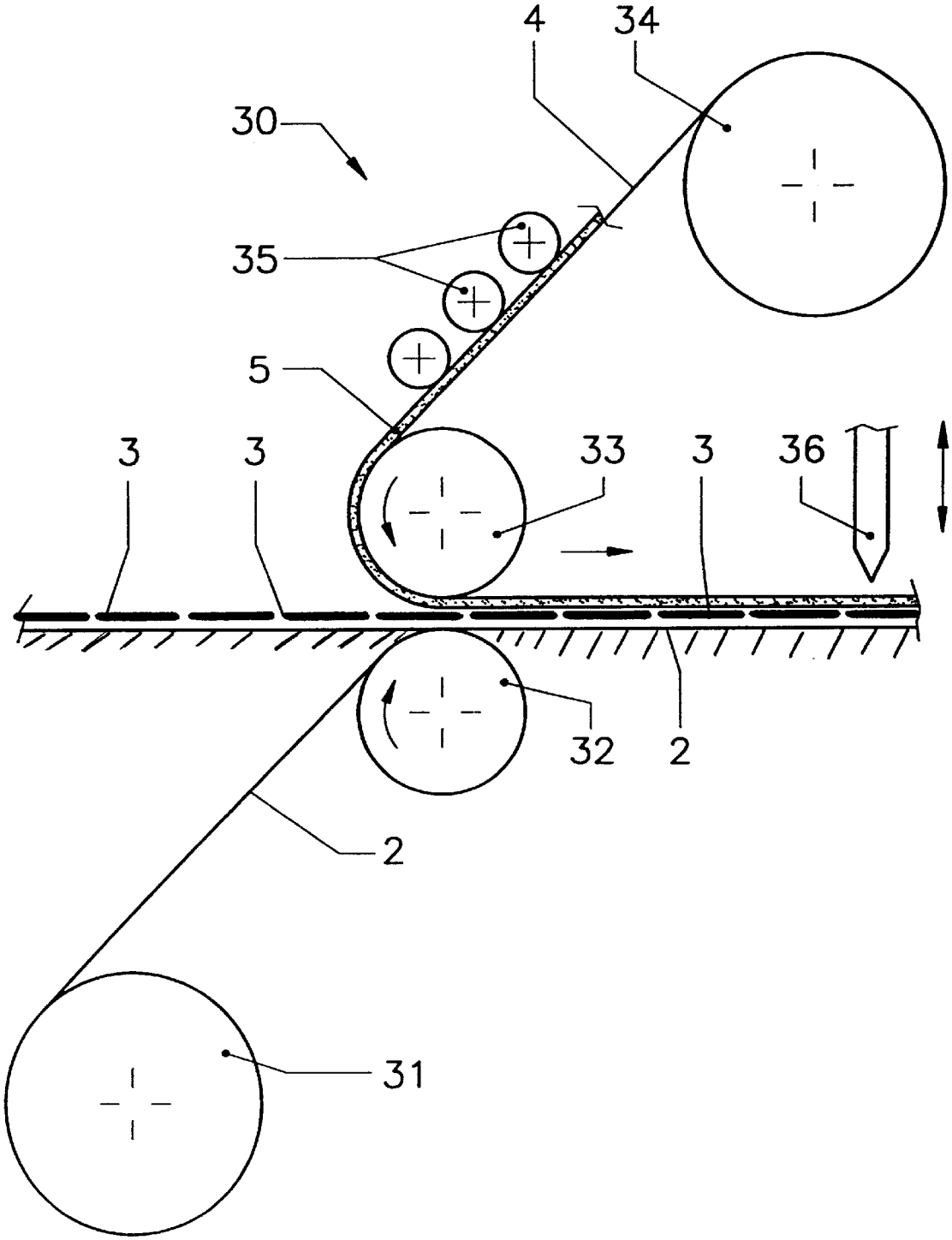

FIG. 4 diagrammatically shows the apparatus 30 which is used for producing the containers 1. The reinforcing insert 3 in the form of printed sheets are applied by means of a known feeder apparatus to the film layer 2 which is advantageously unwound from a roll 31 and advanced along a plane P. The inserts are fed at the desired spacings between two pressure rollers 32 and 33. The film 4 is unrolled from a roll 34 and, by means of coating cylinders 35, is covered on its external face with a layer of glue 5.

It is also possible to use a pre-glued film 4. The guide and pressure rollers 32, 33 which can advantageously be heated pressure rollers join together the "sandwich" structure produced in that way.

Disposed downstream of the rollers 32 and 33 is a blade-type cutter 36 which is movable up and down in a controlled manner. The blade 36 makes it possible to separate the joined films 2 and 3, at the same time producing an opening 40 for the container 1.

It is possible to replace the common bags of paper material or electrically welded synthetic material by the above-described wrappers or containers and in substance the results deriving from the typical operations for dealing with the sheet are combined with the result of typical operations for dealing with flexible packaging.

As the advertising message can be produced by means of an economic offset printing process which affords optimum quality the results in terms of colour effect will be outstanding. As the paper or card insert can be produced by means of offset printing, it is possible to achieve the advantage that even very low run numbers can be economically produced.

Finally, as the invention affords the possibility of using a cellulose-based material or synthetic material both for the sheet containing the advertising messages and for the films to be joined together, disposal of the containers after use thereof will be an extremely simple and in particular ecological matter.

The invention also affords the great advantage that production of the various forms of container can be effected without the use of shaping welding or punching tools, entirely eliminating the use of plasticising machines, punching machines and machines for the folding and glueing phase.

By foregoing separation of the individual containers it will be possible to feed an automatic packaging line for introduction of the products involved. It is also possible to provide for cording or beading the material of the container, thus imparting thereto an appearance similar to the conventional containers. The container which is proposed in accordance with the present invention also lends itself in particular for the packaging of lubricated parts or parts which are joined together, since if necessary the container can be glued along four peripheral edges.

The supply of the containers according to the invention will be quick and speedy since the product can be produced by a single manufacturer and it will not be necessary to turn to a plurality of suppliers.

It will also be noted that complicated punching tools are not required for producing the packaging wrappers or containers, but it is sufficient to provide adjustable cutting blades.

What is claimed is:

1. A packaging wrapper for containing an article comprising:

a first film of material having at least one edge;

an adhesive layer in abutting contact with the first film of material;

a reinforcing sheet having a first side and a second side, the first side in abutting contact with the adhesive layer and partially covering the first film and extending to the edge thereof, the second side of the reinforcing sheet being free of adhesive; and a second film of material having a first side and a perimeter thereabout, said second film abutting the second side of the reinforcing sheet, joined to the first film along at least a portion of the perimeter, the first side of the second film and the second side of the reinforcing sheet defining an opening therebetween at the edge for receiving and containing the article.

2. A packaging container for containing an article according to claim 1 wherein materials of identical chemical composition are used for said first film, said second film, and for said reinforcing sheet.

3. A packaging container for containing an article according to claim 2 wherein said material is cellulose-based.

4. A packaging container for containing an article according to claim 2 wherein said material is polypropylene-based.

5. A packaging container for containing an article according to claim 1 wherein at least one of said films is transparent.

6. A packaging container for containing an article according to claim 1 wherein said reinforcing sheet contains a message on the first side.

7. A packaging container for containing an article according to claim 1 wherein said reinforcing sheet contains a message on the second side.

8. A packaging container for containing an article according to claim 1 wherein at least one of said first and second films is folded to define a closure flap.

9. A packaging container for containing an article according to claim 1 wherein at least one of said first and second films contains a cut-out opening.

* * * * *

UNITED STATES PATENT AND TRADEMARK OFFICE

CERTIFICATE OF CORRECTION

PATENT NO. : 6,256,913 B1
DATED : July 10, 2001
INVENTOR(S) : Rodolfo Pellegri

It is certified that error appears in the above-identified patent and that said Letters Patent is hereby corrected as shown below:

Title page,
Item [30], Foreign Application Priority Data, change "MI97A2510" to
-- MI97A002510 --.

Signed and Sealed this

Twenty-eighth Day of June, 2005

JON W. DUDAS
*Director of the United States Patent and Trademark Office*